United States Patent [19]

Westin

[11] Patent Number: 5,076,903

[45] Date of Patent: Dec. 31, 1991

[54] ANODIZING RACK AND CLAMPS

[75] Inventor: Richard A. Westin, Chaska, Minn.

[73] Assignee: Sequel Corporation, Chaska, Minn.

[21] Appl. No.: 653,138

[22] Filed: Feb. 11, 1991

[51] Int. Cl.[5] ..... C25D 17/08

[52] U.S. Cl. ..... 204/279; 204/297 W

[58] Field of Search ..... 204/297 W, 297 R, 286, 204/279

[56] References Cited

U.S. PATENT DOCUMENTS

| | | | |
|---|---|---|---|
| 3,803,012 | 4/1974 | Kurr | 204/286 X |
| 4,077,865 | 3/1978 | Müller | 204/297 W |
| 4,085,997 | 4/1978 | Hainsworth | 204/297 W X |
| 4,176,039 | 11/1979 | Wismer | 204/297 W |
| 4,615,785 | 10/1986 | Pulido | 204/297 W |
| 4,664,771 | 5/1987 | Docktor et al. | 204/297 W |

*Primary Examiner*—Donald R. Valentine

*Attorney, Agent, or Firm*—Burd, Bartz & Gutenkauf

[57] ABSTRACT

A metallic rack for holding workpieces to be anodized. The rack has a pair of opposed spaced apart parallel elongated clamp-supporting rack members and connecting cross-members. It is characterized by a longitudinal channel in each of the clamp-supporting members having openings of narrower width than the bottoms of the channels. The rack is used in combination with a plurality of pairs of acid-proof electrically non-conductive clamps in slideable engagement with the rack for holding the articles to be anodized. The clamps are characterized by foot members of cross-section corresponding to the cross-section of the channel in the clamp-supporting rack member. The clamp consists of a first frame member extending from the foot member, a second frame member extending from the end of the first frame member generally perpendicular thereto, and an operating screw comprising the moveable jaw of the clamp and acting in cooperation with the rack member functioning as the fixed clamp jaw.

20 Claims, 3 Drawing Sheets

ANODIZING RACK AND CLAMPS

BACKGROUND OF THE INVENTION

1. Field of the Invention

This invention is directed to an anodizing rack and clamps for holding articles for immersion into a liquid anodizing bath. Anodizing is a treatment process for the deposition of a film of synthetic oxide on a light metal, such as aluminum, to provide improved abrasion resistance, corrosion resistance, and cosmetic appearance. The article to be anodized is immersed in an aqueous acid solution and voltage is applied with the article to be anodized functioning as the anode.

2. The Prior Art

According to current anodizing practice the metalic article to be anodized is attached to a rack or frame of the same metal by means of C-clamps of conventional configuration composed of electrically non-conductive synthetic resinous plastic material. Anodizing usually involves the simultaneous treatment of a plurality of like metallic articles. Securing these articles to an anodizing rack using conventional C-clamps is a tedious repetitious time consuming process. The present invention is directed to the provision of means for simplifying and expediting the mounting of a plurality of like articles onto a rack for anodizing treatment.

SUMMARY OF THE INVENTION

The present invention is directed to a metallic anodizing rack having a pair of opposed spaced apart parallel elongated clamp-supporting rack members and connecting cross-members characterized by a longitudinal channel in each of the clamp-supporting members having openings of narrower width than the bottoms of the channels. The rack is used in combination with a plurality of pairs of acid-proof electrically non-conductive clamps in slideable engagement with the rack for holding the articles to be anodized. The clamps are characterized by foot members of cross-section corresponding to the cross-section of the channel in the clamp-supporting rack member. The clamp consists of a first frame member extending from the foot member, a second frame member extending from the end of the first frame member generally perpendicular thereto, and an operating screw comprising the moveable jaw of the clamp and acting in cooperation with the rack member functioning as the fixed clamp jaw.

BRIEF DESCRIPTION OF THE DRAWINGS

The invention is illustrated in the drawings in which corresponding parts are identified by the same numerals and in which.

DETAILED DESCRIPTION OF THE PREFERRED EMBODIMENT

Figure 1:
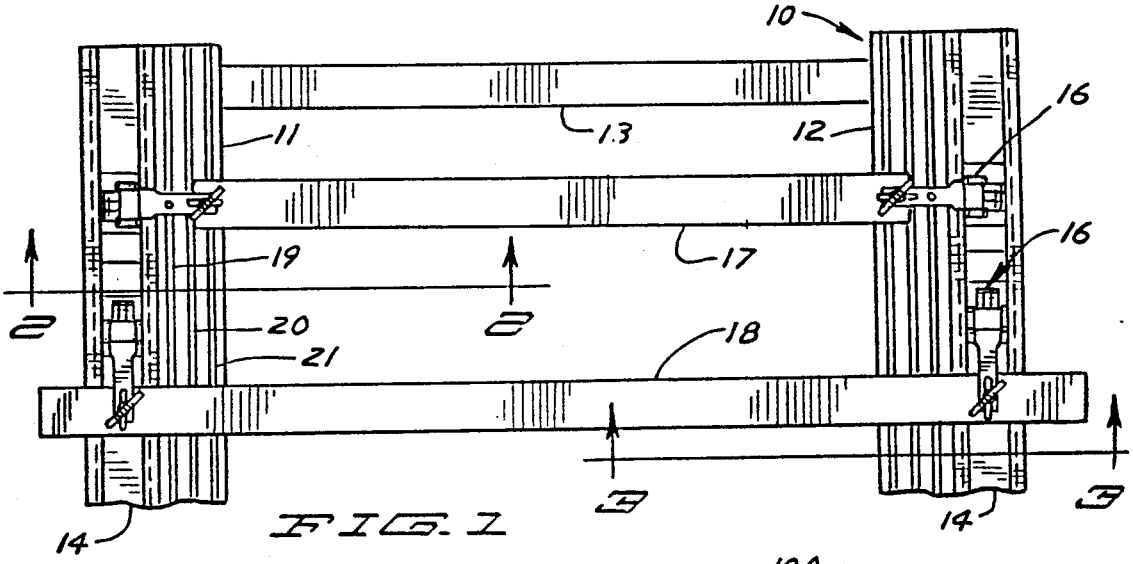
FIG. 1 is a partial elevation of an anodizing rack utilizing toggle clamps according to the present invention shown in two different orientations.
Figure 2:
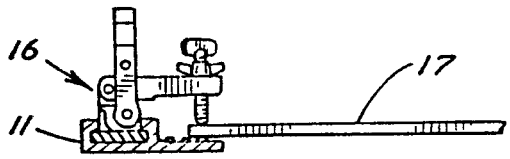
FIG. 2 is a section on the line 2—2 of FIG. 1 and in the direction of the arrows.
Figure 3:
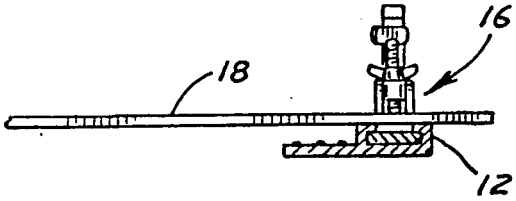
FIG. 3 is a section on the line 3—3 of FIG. 1 and in the direction of the arrows.
Figure 7:
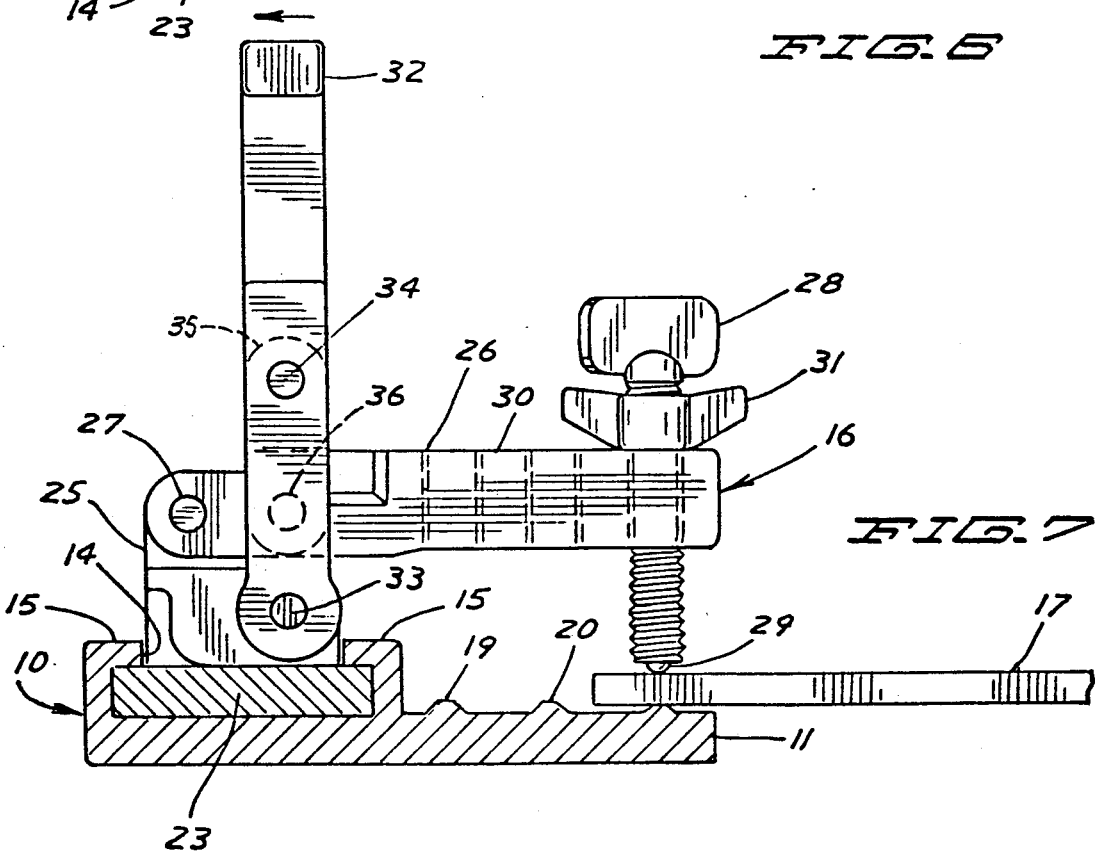
FIG. 7 is a section on the line 7—7 of FIG. 6 and in the direction of the arrows.

Referring now to the drawings, and particularly to FIGS. 1-3, there is shown a partial elevation of one form of anodizing rack, indicated generally at 10, comprised of a pair of opposed spaced apart parallel elongated clamp-supporting rack members 11 and 12 disposed in mirror image relation and at least two parallel cross members 13 rigidly connected to the clamp-supporting members in a rigid rectangular configuration. The anodizing rack is composed of the same metal, usually aluminum, as the articles to be anodized. Each clamp supporting member of the rack 10 has a longitudinal channel 14 adjacent its outer edge. As best seen in FIG. 7 the opening to channel 14 is of narrower width than the bottom of the channel. In the illustrated structure this is accomplished by means of inwardly directed opposed parallel flanges 15. Alternatively, channels 14 may be of internally beveled construction sloping from the narrower opening to the broader bottom of the channel. A plurality of clamps, here shown as toggle clamps 16, as described in greater detail hereinafter, are in slideable engagement with the clamp-supporting members in channels 14. Appropriate stop means are provided at one end of each channel 14 to retain the clamps and spacers therein. The clamps 16 may be oriented on the rack so as to face inwardly toward one another so as to hold a work piece 17 between them in electrical contact with the rack. Where longer work pieces 18 are to be anodized, the clamps 16 may be oriented longitudinally of the clamp-supporting rack members. To minimize the area of contact between the work piece 17 to be anodized and the anodozing rack, as best seen in FIG. 7, the clamp-supporting members may optionally be provided with one or more longitudinal ridges 19-21 of decreasing height from the outer to the inner edges of the members.

Figure 4:
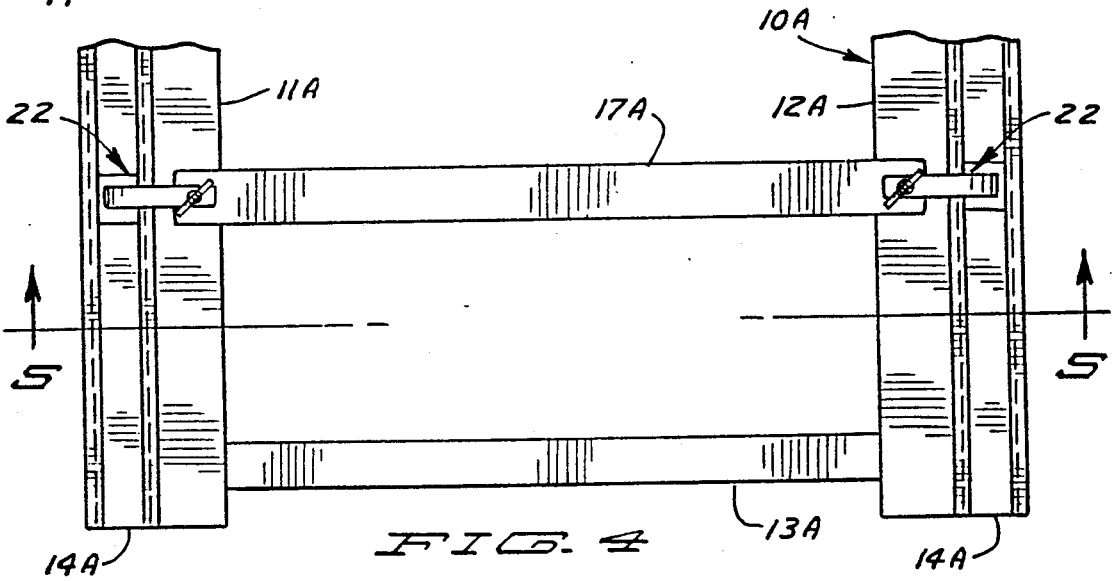
FIG. 4 is a partial elevation of an anodizing rack utilizing a modified C-clamp according to the present invention.
Figure 5:
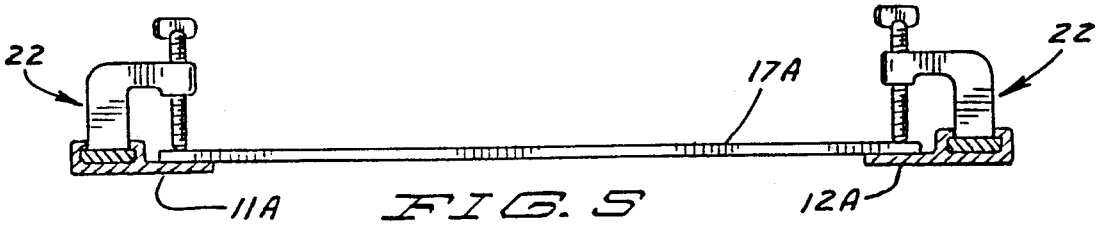
FIG. 5 is a section on the line 5—5 of FIG. 4 and in the direction of the arrows.

Referring now to FIGS. 4 and 5, there is shown a slightly modified form of anodizing rack 10A in fragmentary elevation, comprised of opposed spaced apart parallel elongated clamp-supporting rack members 11A and 12A rigidly connected by at least two cross members 13A. This alternative form of rack does not include the optional ridges 19-21. Inwardly facing modified C-clamps 22 in slideable engagement with the rack in channels 14A hold a work piece 17A in electrically conductive contact with the rack.

Figure 6:
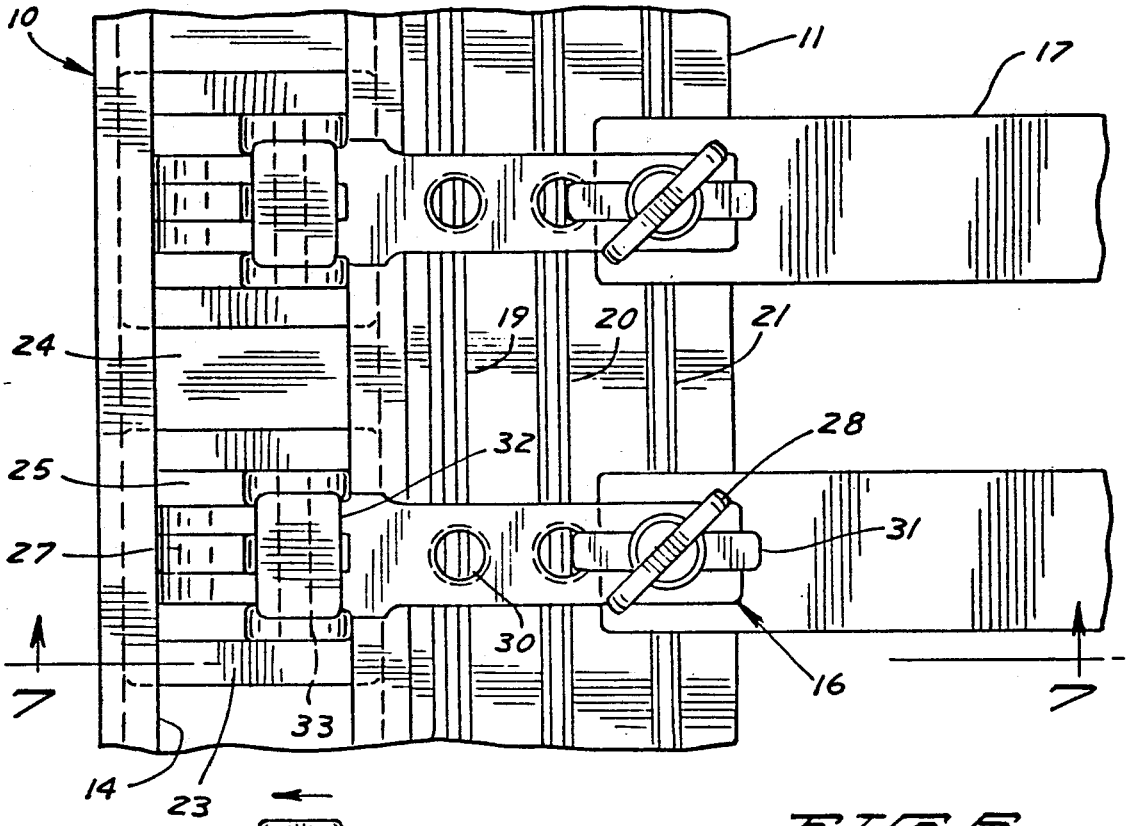
FIG. 6 is a fragmentary elevation, on an enlarged scale, showing toggle clamps in place in an anodizing rack.

Referring now to FIGS. 6 and 7, there is shown in greater detail the structure of toggle clamps 16 and their relation to the anodizing rack. Each camp 16 includes a rectangular foot or base 23 adapted to be received in channel 14 with a close slide fit for easy assembly of an anodizing rack of desired configuration to hold a vast variety of workpieces to be anodized of varying sizes and shapes. As shown, foot 23 is provided with parallel inwardly extending shoulders so as to be retained in channel 14. If clamp foot 23 is square, then the clamp may be installed in the rack in either of the configurations shown in FIG. 1 to hold workpieces either smaller than or larger than the rack. Spacers 24 of appropriate sizes, having the same length and thickness as foot 23 likewise fit in channel 14 of the rack to provide appropriate spacing of the several clamps.

Each toggle clamp 16 includes a first frame member 25 extending from the foot 23 and a second frame member 26 extending from the end of the first frame member generally perpendicular thereto in the closed position. The frame members 25 and 26, in conjunction with the clamp support members 11 and 12 define the jaw of the clamp. The clamp includes an operating screw, here shown as thumb screw 28, threadably engaging frame member 26, and extending generally parallel to the first frame member 25, and defining the throat of the clamp therewith. Preferably the end of screw 28, which functions as the moveable jaw of the clamp, is provided with a tip 29 of reduced diameter to minimize the contact area between the clamp and workpiece which is protected from the anodizing action. Desirably, to permit accommodation of workpieces of varying sizes, frame member 26 includes several spaced apart threaded passages 30 for receiving screw 28. As shown, each of the passages 30 overlies one of the ridges 19–21. Preferably a locking nut 31 is provided to hold screw 28 in place so that adjustment is not necessary each time a new work piece is inserted, where a large run of identical work pieces are being anodized.

In the case of a toggle clamp, the jaw may be readily opened for quick and easy installation and removal of work pieces without the necessity of adjusting the operating screw each time. This is accomplished by moving handle 32 whose bifurcated inner end straddles and is pivotally connected to frame member 25 at 33. As is well understood, handle 32 is pivotally connected at 34 to one end of a toggle link 35 whose opposite end is pivotally connected to frame member 26 at 36. As handle 32 is moved in the direction of the arrow rotating on pivot 33, link 35 rotating on pivots 34 and 36 causes frame member 26, rotating on pivot 27 to be lifted from the work 17.

Figure 8:
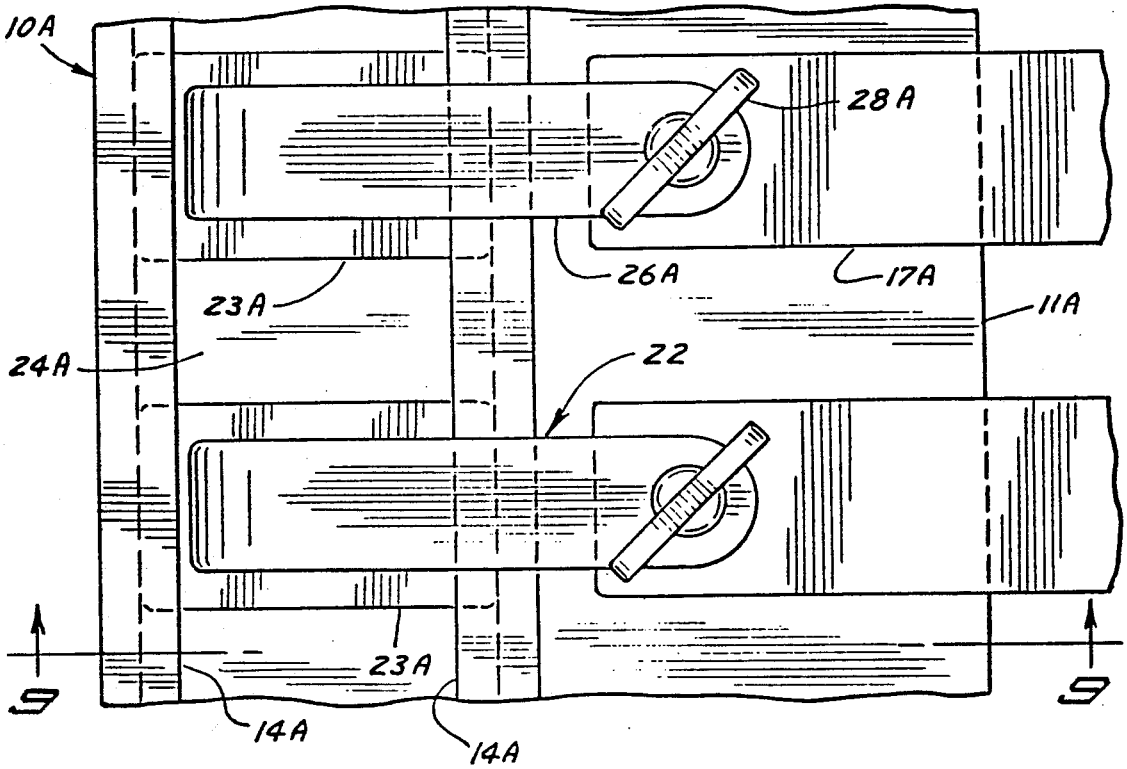
FIG. 8 is a similar fragmentary elevation showing C-clamps in place in an anodizing rack.
Figure 9:
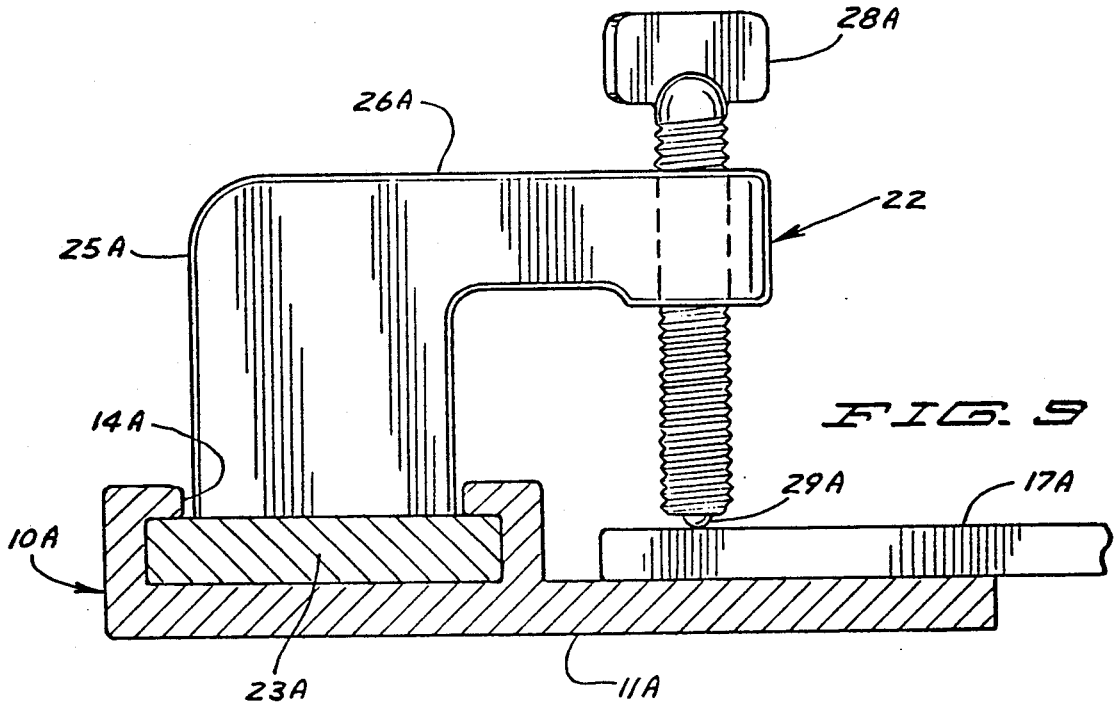
FIG. 9 is a section on the line 9—9 of FIG. 8 and in the direction of the arrows.

Referring now to FIGS. 8 and 9, there is shown in greater detail the details of modified C-clamp 22. The clamp includes a foot or base 23A adapted to be received with a close slide fit into channel 14A of the clamp support members. Spacers 24A may be provided as appropriate. The clamp includes a first frame member 25A extending from the foot 23A and a second frame member extending from the end of the first frame member generally perpendicular thereto. The free end of the second frame member 26A includes a operating screw, here shown as a thumb screw 28A, whose end 29A is preferably provided with a tip of reduced diameter. Screw 28A extends generally parallel to frame member 25A and defines the throat of the clamp therewith. This modified C-Clamp functions in the usual manner as is well understood to hold work pieces in place in the anodizing rack. Here too, if the foot 23A is square the clamp 22 may be installed to hold work pieces which are longer than might otherwise be accommodated.

Clamps 16 and 22 of necessity must be formed from electrically non-conductive material. At the same time, they must be capable of withstanding the harsh acidic environment of the anodizing vessel without dissolving, pitting, or other corrosive action. A number of synthetic resinous plastic materials are available which have the requisite properties. Preferred materials include thermoplastic phenylene oxide-based resins formulated from oxidative coupling of phenolic monomers. This family of resins is characterized by outstanding dimensional stability at elevated temperatures, broad temperature use range, outstanding hydrolytic stability and excellent dielectric properties over a wide range of frequencies and temperatures. These materials are sold by General Electric Company under the trademark NORYL. An especially preferred material is the glass filled product sold as Noryl GFN-3 which is approximately 30% glass filled.

The embodiments of the invention in which an exclusive property or privilege is claimed are defined as follows:

1. An acid-proof electrically non conductive clamp for holding articles to be anodized on a rack for immersion into a liquid anodizing bath, said clamp comprising:

A) a foot member adapted for attachment to an anodizing rack,

B) a first frame member extending from said foot member,

C) a second frame member extending from the end of said first frame member generally perpendicular thereto, D) at least one internally threaded passage in said second frame member spaced from said first frame member, E) an operating screw within one of said threaded passages, said screw being spaced from and generally parallel to said first frame member and defining the throat of the clamp therewith, and F) screw turning means at the end of said screw farthest from said foot member, the opposite end of said screw, comprising the moveable jaw of the clamp, being adapted to hold an article to be anodized securely against an anodizing rack.

2. A clamp according to claim 1 wherein said foot member is rectangular and includes at least one pair of parallel outwardly extending shoulders on opposite sides thereof, said shoulders being slideably engageable with a flanged channel in an anodizing rack.

3. A clamp according to claim 1 wherein said first and second frame members are pivotally connected in a toggle connection.

4. A clamp according to claim 1 wherein said first and second frame members are integral.

5. A clamp according to claim 1 wherein said second frame member includes a plurality of spaced apart parallel threaded passages.

6. A clamp according to claim 1 wherein said operating screw is a thumb screw.

7. A clamp according to claim 1 wherein a locking nut is disposed on said operating screw between the screw turning means and second frame member.

8. A clamp according to claim 1 wherein the end of the operating screw comprising the moveable jaw of the clamp is a projection of reduced diameter.

9. A clamp according to claim 1 wherein said clamp parts are composed of a synthetic phenylene oxide-based resin.

10. A clamp according to claim 9 wherein said resin is 30% glass filled.

11. In combination:

A) a metalic anodizing rack including:

1) a pair of opposed spaced apart parallel elongated clamp-supporting rack members and cross-members rigidly connecting the clamp-supporting members, 2) a longitudinal channel in each of said claim-supporting members, said channels having openings of narrower width than the bottom of said channels, and 3) stop means at one end of each of said channels, and B) a plurality of pairs of acid-proof electrically non-conductive clamps in engagement with said rack for holding articles to be anodized for immersion in an anodizing bath, one clamp of each of said pairs of clamps being in engagement with one of said opposed clamp-supporting rack members, each of said clamps comprising:

1) a foot member of cross-section corresponding to the cross-section of the rack channel for slideable engagement therein, 2) a first frame member extending from said foot member, 3) a second frame member extending from the end of said first frame member generally perpendicular thereto, 4) at least one internally threaded passage in said second frame member spaced from said first frame member, 5) an operating screw within one of said threaded passages, said screw being spaced from and generally parallel to said first frame member and defining the throat of the clamp therewith, and 6) screw turning means at the end of the screw farthest from said foot member, the opposite end of the screw, comprising the moveable jaw of the clamp, being adapted to hold an article to be anodized securely in contact with the clamp-supporting rack member.

12. A combination according to claim 11 wherein an acid-proof electrically non-conductive spacer of cross-section corresponding to the cross-section of the rack channel is in engagement with the channel between each adjacent pair of clamps.

13. A combination according to claim 11 wherein said clamp foot members are square whereby clamps may be oriented longitudinally or transversely relative to the clamp-supporting rack members.

14. A combination according to claim 11 wherein said rack is composed of aluminum and said clamp parts are composed of a synthetic phenolene oxide-based resin.

15. The combination of claim 11 wherein said first and second clamp frame members are pivotally connected in a toggle connection.

16. A combination according to claim 11 wherein said first and second clamp frame members are integral.

17. A combination according to claim 11 wherein said second clamp frame member includes a plurality of spaced apart parallel threaded passages.

18. A combination according to claim 11 wherein said clamp operating screw is a thumb screw.

19. A combination according to claim 1 wherein a locking nut is disposed on said clamp operating screw between the screw turning means and second clamp frame member.

20. A combination according to claim 11 wherein the end of the clamp operating screw comprising the moveable jaw of the clamp is a projection of reduced diameter.

* * * * *

UNITED STATES PATENT AND TRADEMARK OFFICE

CERTIFICATE OF CORRECTION

PATENT NO. : 5,076,903

DATED : December 31, 1991

INVENTOR(S) : Richard A. Westin

It is certified that error appears in the above-identified patent and that said Letters Patent is hereby corrected as shown below:

Col, 2, line 60, delete "camp" and insert --- clamp ---.

Col. 4, line 14, insert a hyphen after "non".

Col. 6, line 25, delete "1" and insert --- 11 ---.

Signed and Sealed this

Twenty-eighth Day of December, 1993

*Attest:*

Bruce Lehman

BRUCE LEHMAN

*Attesting Officer*

*Commissioner of Patents and Trademarks*